US008717169B2

(12) United States Patent
Rodger et al.

(10) Patent No.: US 8,717,169 B2
(45) Date of Patent: May 6, 2014

(54) AIR TRAFFIC CONTROLLER ALERTING SYSTEM

(75) Inventors: Bruce C. Rodger, Los Angeles, CA (US); Ross F. Aimer, San Clemente, CA (US)

(73) Assignee: Velocity Metrics, LLC, West Hollywood, CA (US)

( * ) Notice: Subject to any disclaimer, the term of this patent is extended or adjusted under 35 U.S.C. 154(b) by 171 days.

(21) Appl. No.: 13/490,218

(22) Filed: Jun. 6, 2012

(65) Prior Publication Data

US 2012/0306649 A1 Dec. 6, 2012

Related U.S. Application Data

(60) Provisional application No. 61/493,903, filed on Jun. 6, 2011.

(51) Int. Cl.
*G08B 21/00* (2006.01)
*G08B 23/00* (2006.01)

(52) U.S. Cl.
USPC ..... 340/540; 340/575; 340/947; 701/120

(58) Field of Classification Search
USPC ..... 340/540, 575, 573.1, 576, 945, 947, 340/948, 953, 958, 963, 965; 701/9, 14, 15, 701/16, 120
See application file for complete search history.

(56) References Cited

U.S. PATENT DOCUMENTS

| | | | | |
|---|---|---|---|---|
| 5,659,475 | A * | 8/1997 | Brown | 701/120 |
| 6,571,167 | B2 * | 5/2003 | Schmidt | 701/120 |
| 8,339,285 | B2 * | 12/2012 | Boren et al. | 340/965 |
| 2010/0109913 | A1 * | 5/2010 | Nitzan et al. | 340/947 |

* cited by examiner

*Primary Examiner* — Anh V La
(74) *Attorney, Agent, or Firm* — Snell & Wilmer LLP

(57) ABSTRACT

A monitoring and alerting system for installation in an air traffic control facility. The alerting system monitors the outgoing transmissions from the control facility to secondary locations, the responsiveness of the control facility personnel to aircraft communications or both. The monitoring and alerting system utilizes multiple stages of alerts for the air traffic controllers. In a first stage, a light source is displayed within the control facility. In a second stage, an audible noise is sounded within the control facility. In a third stage, an audible noise of increased volume is sounded in or near the control facility, a notice is sent to command and control and/or an indication is sent to a Central Control Facility. The three stages of alerts are progressively activated if the personnel in the control facility fail to adequately utilize connected equipment monitored by the alerting system within predetermined time periods.

20 Claims, 6 Drawing Sheets

AIR TRAFFIC CONTROLLER ALERTING SYSTEM

CROSS REFERENCE TO RELATED APPLICATIONS

This application claims the benefit and priority of U.S. Provisional Application No. 61/493,903, filed on Jun. 6, 2011, the entire contents of which are hereby incorporated by reference.

BACKGROUND

1. Field

The present invention relates generally to alerting systems and improvements thereof. More particularly, the present invention relates to monitoring and alerting systems and methods for air traffic control and improvements thereof.

2. Description of the Related Art

Inattentive personnel in air traffic control positions have become a significant safety concern in recent years. Falling asleep while on the job can have considerable consequences given the wide range of duties for which air traffic controllers are responsible. A typical control tower manned by traffic controllers is responsible for overseeing and directing both ground traffic and air traffic. Aircraft wishing to descend to a runway for landing or taxi to the runway for take-off must first be given clearance or authorization from the control tower that it is safe to do so to ensure such movement will not interfere with the travel paths of other aircraft or vehicles. During most daytime shifts, when the control tower is busiest, multiple individuals may be working in the control tower to handle the various responsibilities. However, during nighttime shifts or periods where air traffic is expected to be minimal, the number of individuals assigned and manning the control tower is greatly decreased. Recent budgetary considerations have lately resulted in reduced number of staff or personnel in charge of controlling all of the duties of the control tower during these off-peak shifts.

The lack of any direct human interaction with other individuals in the control tower combined with the long time periods of general boredom from minimal aircraft activity and the relative darkness during nighttime hours has lead to a large increase in accidental napping by air traffic controllers. For example, in the first five months of 2011, the FAA disclosed that seven air traffic controllers had been found sleeping while at work. In addition, a 39% increase in errors at air traffic control facilities that handle aircraft at high altitudes has been noted by the Transportation Department Inspector General. Errors such as aircraft flying too close together, missed emergency requests or requests to land and a variety of other mistakes can result in injury or death to travelers. While decreased staffing may meet budgetary demands, the resulting public safety consequences are quickly demanding an alternative solution. A system that monitors activity in the control tower and Air Traffic Control (ATC) facilities to ensure alertness of the personnel is needed and would allow staffing to remain minimal during periods of decreased aircraft activity without sacrificing public safety in the process.

In the field of monitoring and alerting systems, a variety of solutions have been designed to help ensure an individual remains focused or attentive while participating in a specific activity. Driver attentiveness systems for automobiles have been developed that monitor various input parameters such as vehicle speed, use of brake pedals, steering wheel operation or lack of driver response to instructions from the system (such as verbally repeating a series of words) to determine whether a driver is paying attention while driving the automobile. If the system determines the driver is inattentive, light and sound emitting elements are successively activated to gain the driver's attention.

Other vigilance monitoring systems have been developed, more generic in nature, for installation in a variety of settings or applications, such as for the operation or guidance of military equipment, commercial airliners, or nuclear power plants. These systems intervene when sensing inactivity of an individual by visual, aural or touch-based stimuli. Aircraft themselves have been outfitted with such alerting systems to ensure pilots do not fall asleep while operating an airborne aircraft. Some methods have been envisioned as applicable to air traffic control settings and where physical characteristics such as eye blinks, heat or physical movement are used to monitor activity.

However, an inexpensive monitoring and alerting system has yet to be developed and used in the air traffic control field despite the benefits of such a system. One of the biggest hurdles to investment in such a system is the high cost of current monitoring solutions. There is a need for an inexpensive alerting system that can be easily installed within existing control towers and ATC facilities without requiring prohibitively expensive retrofitting of components or systems. The ideal system would be compatible with existing control tower equipment or devices, would be relatively simple to operate and would utilize a minimal amount of hardware since complexity and addition of components increases cost, both in initial install or setup and in ongoing maintenance. The ideal alerting system would also operate in stages with progressively intrusive alerting mechanisms for garnering the awareness of an individual. Furthermore, the ideal system would operate on both a local level within the controlling facility and be capable of external notification outside of or remote to the control tower or ATC facilities.

SUMMARY

A monitoring system for alerting an air traffic controller is disclosed. In one embodiment, an air traffic control alerting system may include a communication device for communicating with a remote location, the communication device having a transmit state and a receive state. A controller is configured to monitor the communication device for determining if the communication device is in the transmit state or the receive state. A visual indicator is coupled with the controller and configured to be activated by the controller if the communication device does not change from the receive state to the transmit state after a first predetermined amount of time. An audible indicator is coupled with the controller and configured to be activated by the controller at a first volume if the communication device does not change from the receive state to the transmit state after a second predetermined amount of time after the activation of the visual indicator. A notification is configured to be sent by the controller to a remote device if the communication device does not change from the receive state to the transmit state after a third predetermined amount of time after the activation of the audible indicator at the first volume. Keying the communication device for transmission at any time may reset the system to its basic monitoring state.

In another embodiment, an air traffic control alerting system for use in an air traffic control facility may include a receiver for receiving, over at least one frequency, an incoming communication at the air traffic control facility from a location remote from the air traffic control facility and a transmitter for transmitting, over the at least one frequency, an outgoing communication from the air traffic control facility to the location remote from the air traffic control facility. A controller is configured to monitor the at least one frequency for the incoming communication by the receiver and the outgoing communication by the transmitter. A light is connected with the controller and configured to be activated by the controller after a first predetermined amount of time elapses from receipt of the incoming communication by the receiver if there is no outgoing communication transmitted by the transmitter. A speaker is connected with the controller and configured to be activated by the controller after a second predetermined amount of time elapses from the activation of the light if there is no outgoing communication transmitted by the transmitter. A memory is connected with the controller and configured to store a telephone number and a message, the message transmitted according to the telephone number after a third predetermined amount of time elapses from activation of the speaker if there is no outgoing communication transmitted by the transmitter.

In still another embodiment, a method of reducing inattentiveness during air traffic control communication over at least one frequency between a control tower and an aircraft may include the steps of monitoring the at least one frequency for an incoming communication from the aircraft or an outgoing communication from the control tower, activating a visual indicator after a first predetermined amount of time if no outgoing communication from the control tower has occurred, activating an audible indicator at a first volume after a second predetermined amount of time after the activation of the visual indicator if no outgoing communication from the control tower has occurred, activating the audible indicator at a second volume louder than the first volume after a third predetermined amount of time after the activation of the audible indicator at the first volume if no outgoing communication from the control tower has occurred and sending a pre-recorded message via a network to a remote location after a fourth predetermined amount of time after the activation of the audible indicator at the second volume if no outgoing communication from the control tower has occurred.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Figure 1:
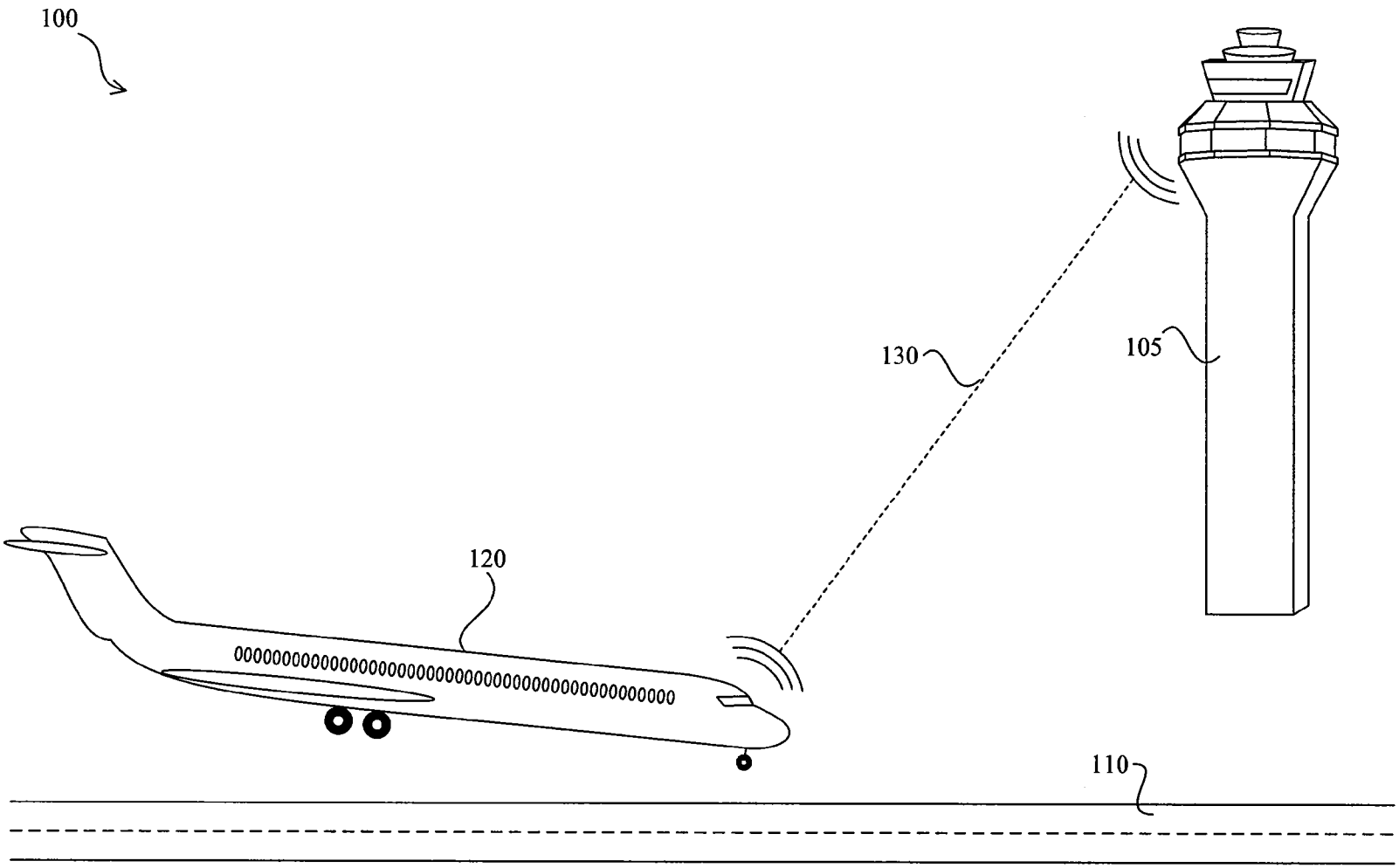
FIG. 1 is a view of an aircraft in communication with an air traffic control tower having an air traffic controller alerting system installed according to an embodiment of the invention.

FIG. 1 shows a portion of an airport or aircraft landing facility 100 having an air traffic control tower 105 and a runway 110. An aircraft 120 desiring to take-off from or land on the runway 110 must first be in communication 130 with personnel manning the control tower 105. The communication 130 between the aircraft 120 and the control tower 105 facilitates a safe arrival or departure of the aircraft 120 since the control tower 105 monitors and guides traffic both in the air and among separate aircraft 120 and on the ground. Ground traffic can be significant due to the large number of land-based vehicles that may be present on or near the runway 110. For example, such vehicles may include airplanes that are not yet airborne, food service trucks for replenishing the meals or snacks on various airplanes, baggage trucks, maintenance vehicles, emergency services vehicles or any other type of land-based vehicle, structure or object that would interfere with the safe landing, take-off or movement of the aircraft 120 on the ground.

The control tower 105 contains a variety of electronic monitoring or communications equipment and devices within the control tower 105 to help the personnel manage and safely direct the traffic discussed above. A variety of computers and associated display devices help locate the position of any airborne traffic in the vicinity. The control tower 105 also includes communications equipment to allow personnel in the control tower 105 to interface with other individuals or departments on the ground of the airport or aircraft landing facility. Additional communications equipment or systems are present in the control tower 105 for making verbal contact with the pilot of the aircraft 120.

The control tower 105 has a variety of operational responsibilities. First, the clearance delivery operations of the control tower 105 are in charge of monitoring and providing clearance or authorization for airplanes on the ground to begin moving to the runway 110 for take-off. Second, the ground control operations of the control tower 105 are in charge of monitoring and controlling surface movement at the airport for the taxiing of the airplane to the runway 110. Third, the control tower operations are in charge of monitoring and controlling air movement of the airplane once it is airborne. The control tower operations supervise air movement of airborne aircraft both on departure from the runway 110 for take-off and on approach to the runway 110 for landing. Once the airborne aircraft 120 leaves a vicinity of the control tower 105, monitoring duties for the aircraft 120 pass to a separate departure control facility with an often larger geographic monitoring zone, as discussed in greater detail herein.

At particularly busy or well-travelled airports, a number of individuals are employed and work within the control tower 105 at once to manage the above mentioned responsibilities. These individuals interface with the monitoring and the communication equipment to manage and control the potentially large amount of traffic at the airport to maintain safe operations. According to one embodiment, an air traffic controller alerting system is installed and cooperates with the equipment or devices already present in the air traffic control tower 105, as discussed in greater detail herein. This alerting system provides progressively intrusive levels of alerts to an individual or individuals manning the control tower 105 in order to ensure attentiveness to their duties. Hence, the alerting system helps mitigate the significant safety problems that arise when personnel on duty in the control tower 105 fall asleep or are otherwise incapacitated and cannot or do not perform the duties so required. The alerting system may additionally or alternatively be installed in any air traffic control facility and is not just limited to control tower implementation.

Figure 2:
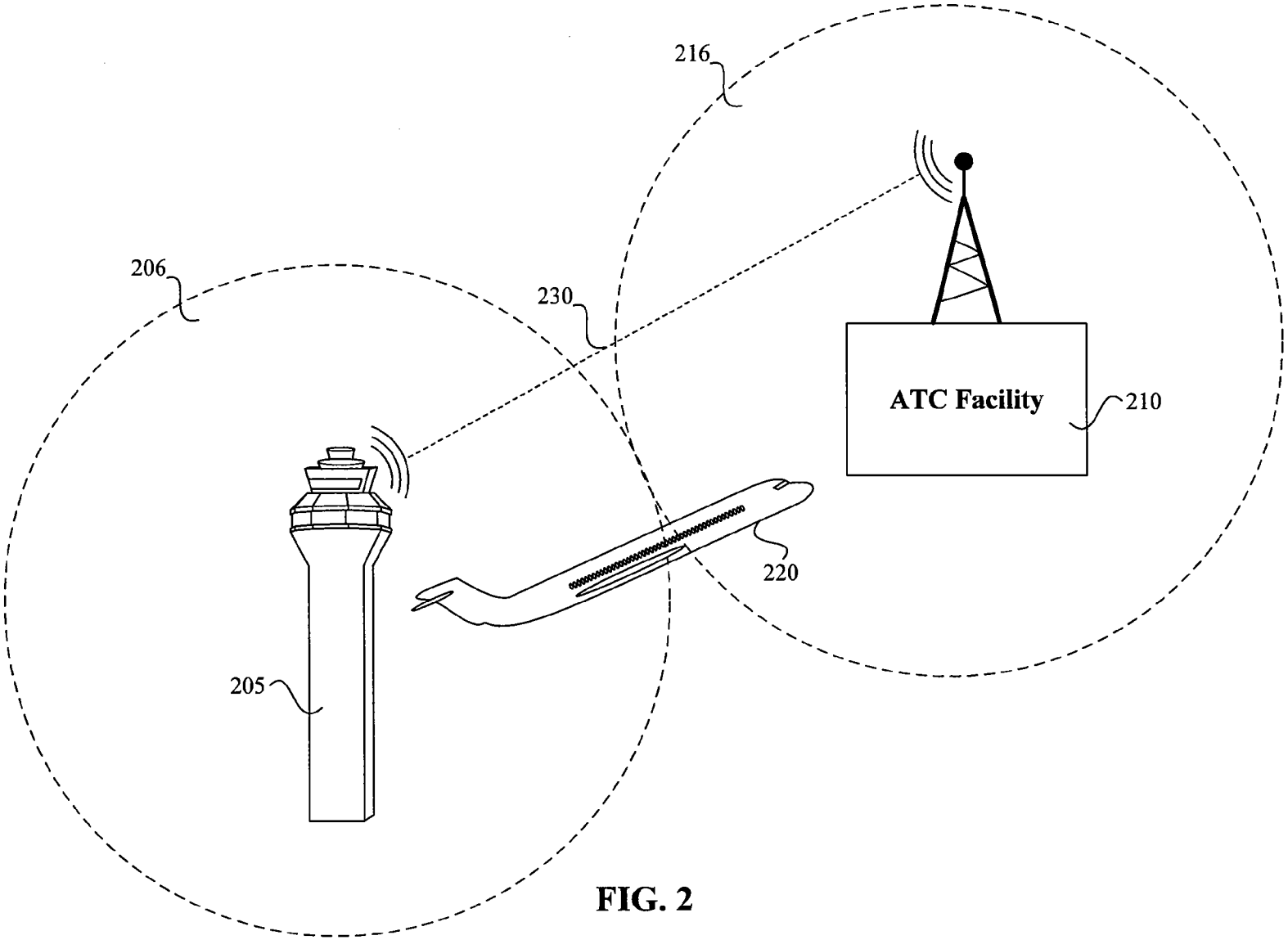
FIG. 2 is a view of an aircraft tracking handoff between two air traffic control facilities having air traffic controller alerting systems installed according to an embodiment of the invention.

Referring next to FIG. 2, an airborne aircraft 220 is shown during a handoff transaction between control towers or departure control facilities. A departure control facility 205 has a first zone of operation 206 as indicated by the dashed line surrounding the departure control facility 205. A controlling ATC facility 210 similarly has a zone of operation 216 as indicated by the dashed line surrounding the controlling ATC facility 210. As stated above for FIG. 1, after the airborne aircraft 220 leaves the vicinity of an airport control tower, monitoring responsibilities of the airborne aircraft 220 pass to a separate departure control or ATC facility. Many ATC facilities may be employed to track the aircraft 220 along its flight path from origin to destination, particularly if the flight path is lengthy and traverses a large geographic area.

As the aircraft 220 travels within the first zone of operation 206, the departure control facility 205 monitors the aircraft 220 and may be in communication with the aircraft 220. Once the aircraft 220 nears or crosses a border between the first zone of operation 206 and the second zone of operation 216, a handoff 230 occurs. During this handoff 230, the departure control facility 205 electronically communicates with the controlling ATC facility 210 to relinquish responsibility for the monitoring, control and communication with the aircraft.

Air traffic safety depends upon adequate handoff 230 of the airborne aircraft 220 so that the air traffic is correctly monitored to prevent aircraft from getting too close and interfering with the flight paths of one another. Moreover, if the aircraft 220 has an emergency, an appropriate handoff 230 ensures the aircraft 220 communicates with the proper monitoring facility. An alerting system may be installed not only within a control tower 105 (see FIG. 1) at an airport, but also at the departure control facility 205 and the ATC facility 210 since they are also involved in managing air traffic and see the same public safety risks when air traffic controllers are inattentive during their shifts.

Figure 3:
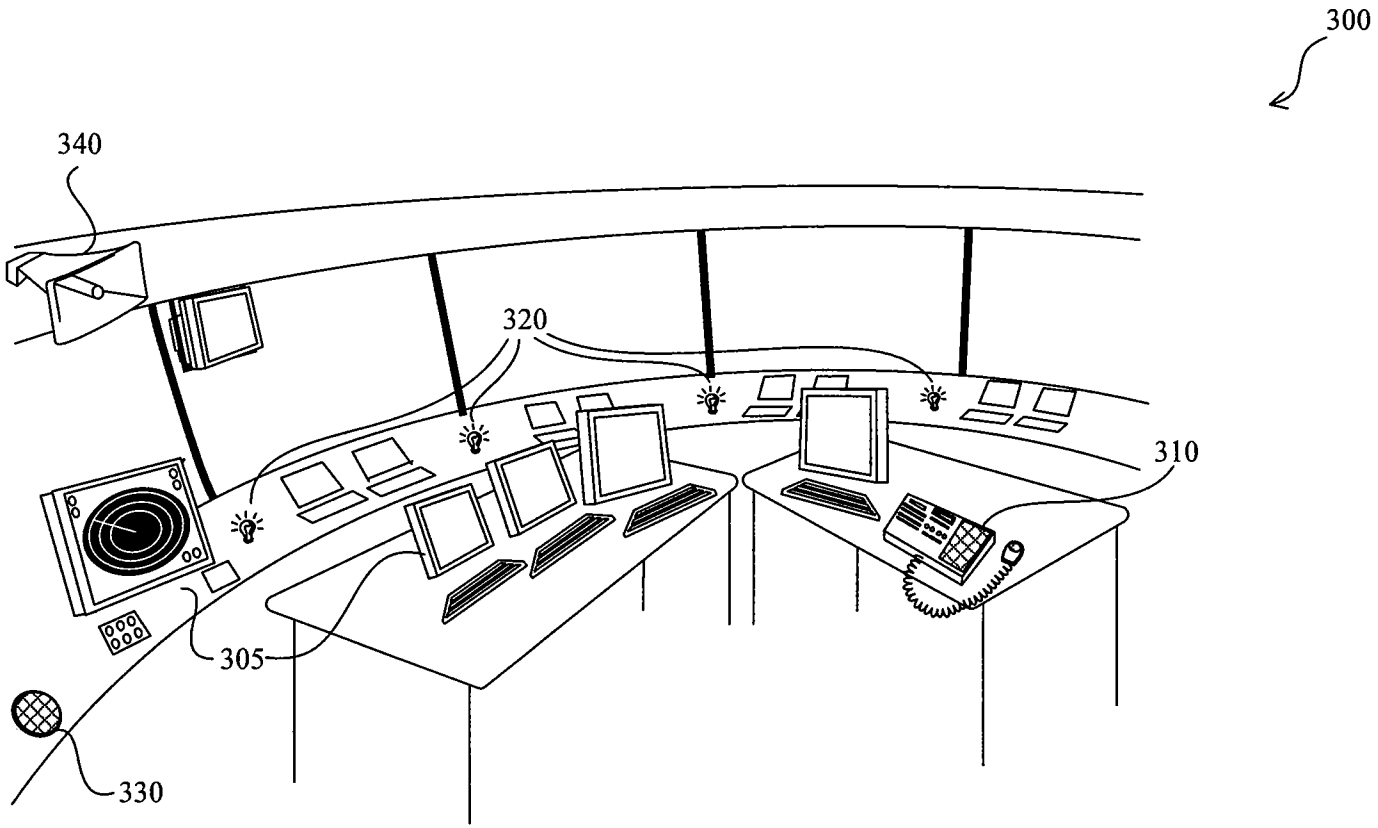
FIG. 3 is a view of an interior of an air traffic control tower having an air traffic controller alerting system installed according to an embodiment of the invention.

Turning now to FIG. 3, an interior 300 of an air traffic control tower, a departure control facility or an ATC facility is shown. An alerting system, as described in greater detail herein, may be installed in such a control tower, departure control facility, ATC facility, or any other air traffic monitoring facility. Various electronic equipment 305 for monitoring air or ground traffic or other flight parameters is present within the interior 300 of the control tower. This electronic equipment 305 may include computer tracking systems, flight database systems, radar equipment, and any other equipment that aids in monitoring or controlling ground or air traffic. In addition, communications equipment 310 is also present within the interior 300 of the control tower. This communications equipment 310 may include radio frequency receiver and/or transmitter control panels and microphones, VHF or UHF transmission components or other controller mode control panels. The communications equipment 310 is used to interface with aircraft, other operational individuals, groups or departments on the ground level at the airport facility. The same communications equipment 310 or different communications systems are used for establishing dialog with an approaching or departing aircraft. By monitoring aircraft and ground parameters via the electronic equipment 305, individuals working within the interior 300 of the control tower can appropriately direct and manage aircraft or ground traffic via the communications equipment 310.

The communications equipment 310 may include a microphone and a speaker and operates via push-to-talk functionality. When an individual working in the interior 300 of the control tower wishes to output or transmit a communication to a second location by interfacing with the communications equipment 310, the individual presses and holds a button or other user-operable component that is disposed on a portion or in the vicinity of the communications equipment 310. Talking into the microphone of the communications equipment 310 while holding the button allows the communications equipment to transmit an outgoing communication or signal. When the button is not pressed or held, the communications equipment 310 is configured to receive incoming communications or signals and sound the received signals through an attached speaker, earpiece, headset or other audible sound system located in the interior 300 of the control tower.

An air traffic controller alerting system is installed and cooperates with or replaces various equipment or components described above. The alerting system is simple in design and utilizes a minimum amount of new hardware or software components. A system controller (e.g., a computer or other electronic controller device) executes software code for controlling the functional operation of the alerting system. By interfacing the system controller with existing equipment or systems already present at the control tower, installation costs are minimized both in materials needed and in ease of labor. To reduce risk of system failure, for example during AC power outage or power fluctuations, a backup power source (e.g., a battery) may be employed for ensuring continued operation of the air traffic controller alerting system. The battery or energy storage component of the backup power source may be configured to charge when the AC power is available.

The air traffic controller alerting system may interface with or monitor a communication device as part of the communications equipment 310 that includes, for example, a radio frequency ("RF") receiver and/or transmitter capable of receiving and/or transmitting over a variety of frequencies. For example, commercial flight communication may utilize VHF frequencies (e.g., 108-138 MHz in 5 KHz steps) while military flight communication may utilize UHF frequencies (e.g., 225-400 MHz in 5 KHz steps). The RF receiver and/or transmitter of the communication device may thus be able to store particular frequency channels or channel banks (e.g., VHF and/or UHF) in a memory of or connected with the radio frequency receiver and/or transmitter in order to monitor communications on user-desired frequency channels. In certain embodiments, the RF receiver and/or transmitter may be configured to simultaneously monitor or communicate on a plurality of frequency channels. By monitoring the communications established via the communication device, the air traffic controller alerting system may determine when or if appropriate communications are occurring without undesirable time delays.

The communication device may have or may interface with a memory for storing various settings of the alerting system. The memory may be a local memory or may be a remote memory, for example, a memory that is connected with the communication device via a web server or over an Ethernet or other communications connection. As discussed in greater detail herein, user-settable or programmable automatic timers corresponding to alerting levels may be stored in the memory. The communication device may also interface with a remote server or web interface (e.g., over the Internet or other network) in order to enable or control remote password and access, frequency assignments for RF monitoring purposes, timer values for alert levels, dialing number information for an internally connected cell phone or Plain Old Telephone Service ("POTS") line, digitized voice messages for playing to the telephone destination during particular alert steps, Ethernet or other internet configuration parameters, information logging and/or statistics generation for the transmitters or other communication components, external access for troubleshooting or other purposes, and/or live streaming of communications. Live streaming, for example, may be allowed such that communications transmitted on the monitored frequencies are digitized for live streaming via the Internet. Thus, individuals interested in tracking a particular aircraft will be able to tune in and listen to real-time streaming of incoming and/or outgoing communications between the desired aircraft and air traffic control personnel at control towers or other ATC facilities.

For example, the communication device may have a controller connected with one or more antennas for sending/receiving communications on one or more communication channel banks. A plurality of input/output connections or ports may allow interfacing between the communication device and an alert reset button, a light, a beeper, a POTS landline, a cellular telephone, an Ethernet/Internet connection, a microphone and/or a speaker. A controller of the communication device may interface with a user-interface device (e.g., a mouse and/or keyboard) and a monitor and is configured to perform the functional characteristics of the alerting system (e.g., alert timers, web server functionality, statistic gathering or calculating, setting of various user preferences, etc.), as discussed in greater detail herein. The controller may also perform frequency control or other processing of the one or more communications. The controller may also be configured to be accessed or interfaced with remotely (e.g., via the Internet or over another network or phone connection), such that a remote user may modify or interface with various user-controllable settings or parameters of the communication device or alerting system. To ensure appropriate security, a login and/or password may be required to gain operational access with the controller or other components of the communication device.

The air traffic controller alerting system may include a plurality of light sources or other visual indicators 320, speakers or audible components 330 and loudspeaker or other siren components 340. The light sources 320, speakers 330 and siren components 340 are positioned and adapted in the interior 300 or in the vicinity of the control tower so as to alert or grab the attention of an individual working in the control tower when they are activated. For example, a light source 320 may be positioned and viewable at each location within a visual proximity where an individual is expected to be seated when working in the control tower or near the communications equipment 310 and the speaker 330 should have a volume loud enough to be heard over nominal sounds in a busy room or to awaken an average individual from a sleeping state. In alternative embodiments of the air traffic controller alerting system, greater or fewer of each of the light sources 320, speakers 330 or siren components 340 may be used and their positioning within the interior 300 or the vicinity of the control tower may be changed.

Figure 4:
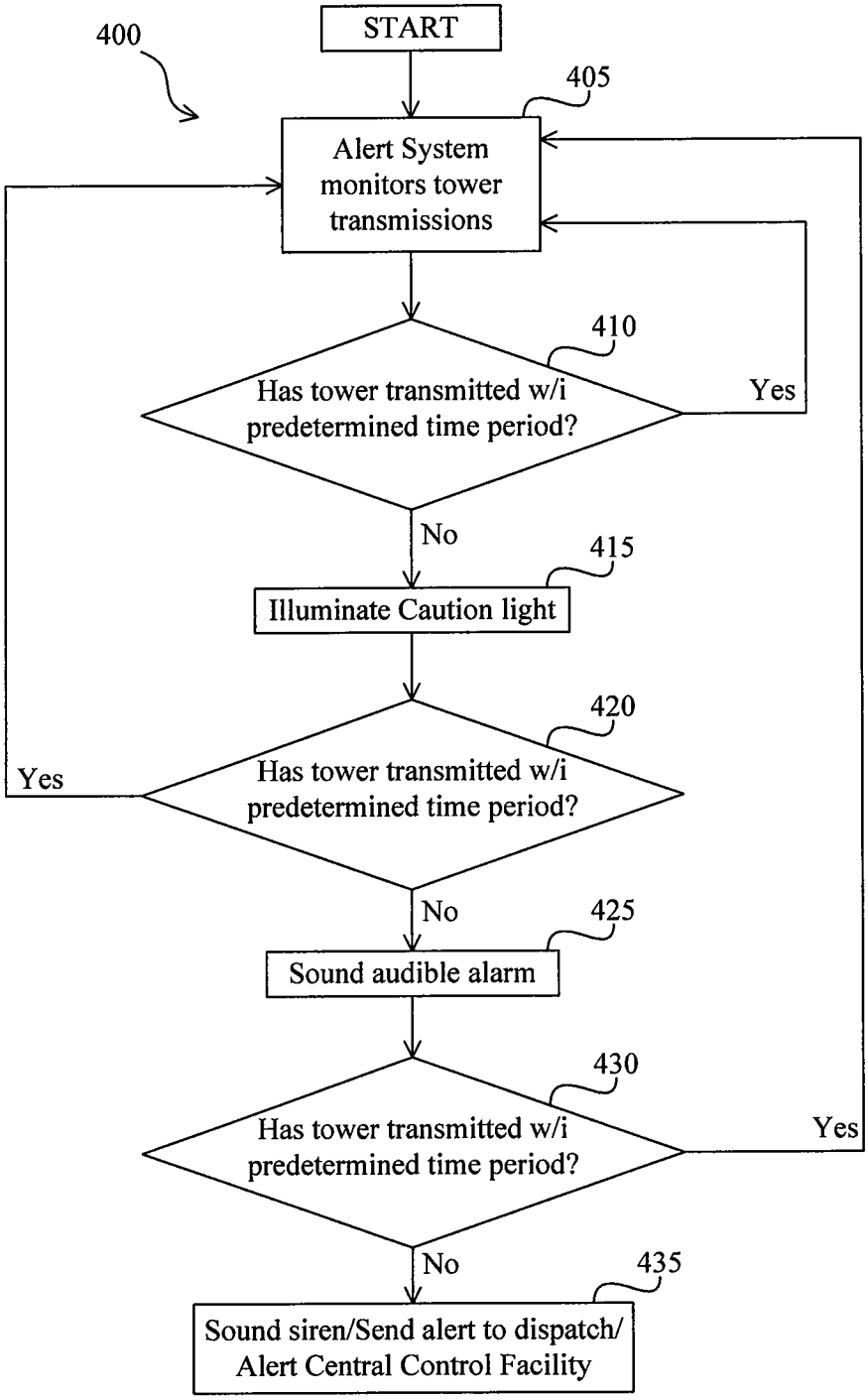
FIG. 4 is a flowchart of an air traffic controller alerting system according to an embodiment of the invention.

The overall operation of an air traffic controller alerting system 400 is shown by the flowchart in FIG. 4. Upon initial boot-up of the system and during non-alerting operation, the alerting system 400 waits in a monitoring state 405 for monitoring outgoing transmissions (e.g., transmittal of an RF signal for more than 0.25 seconds with or without audio modulation), for example, from the communications system 310 (see FIG. 3) of the control tower or ATC facility. In one embodiment, the alerting system 400 observes the outgoing transmissions by monitoring activations of a push button of a communications device (such as a portion of the communications system 310 as discussed in greater detail above for FIG. 3) or by otherwise monitoring the establishment of a particular communication channel or communication. A reset button or other user-interfaceable element (e.g., a test button for verifying proper operation of the equipment during installation or trouble shooting) may also be used to reset the alerting system 400.

Thus, if an individual working in the control tower does not transmit via the communications system 310 by pressing the push-to-talk button of the communications system 310 during a first predetermined amount of time 410 (e.g., ~20 minutes), the alerting system proceeds to a first alerting level 415 by illuminating a caution light or visual indicator visible to the individual in the control tower. Other methods may be employed to activate an outgoing transmission from a communications system and hence are monitored by the alerting system 400 in place or in addition to the push button described above, for example the use of a toggle switch, a foot pedal, etc. A manual reset button may also or alternatively be utilized on a panel of the communications equipment 310 for resetting the alerting system 400.

The first predetermined amount of time 410 is stored as a software-based value in a memory of the alerting system. A controller of the alerting system 400 (e.g., see above discussion for FIG. 3) is configured to access the memory for performing the operations of the alerting system 400. In an alternative embodiment, a hardware-based timing circuit may be used. The predetermined amount of time may be configured differently for each install of the alerting system 400 to allow for different air traffic control facilities to customize the alerting system 400 to the needs of such facilities. Furthermore, the predetermined amount of time 410 may also be easily changeable or programmable after the alerting system 400 is installed to allow for flexible modifications of the timing, for example, to set different amounts of time for different work shifts or times of day. For example, the predetermined amount of time 410 may be individually set from 1-90 minutes in 1 second increments or be disabled entirely.

The illumination of the caution light (e.g., a flashing, strobing, or rotating light) at the first alerting level 415 provides a first visual alert or indication to the individual working within the control tower that the alerting system 400 has detected a lack of transmission from the tower. The caution light may be an advisory message on a computer screen or display device or a message light mounted on a control panel. A plurality of caution lights may be utilized and positioned around the control tower or only one caution light may be used that is visible from everywhere within the control tower. In an alternative embodiment, the first alerting level 415 may include additional or alternative functionality apart from illumination of a light.

To reset the alerting system 400, the individual must press the push button or otherwise activate a transmission of the communications equipment (e.g., the communications equipment 310 of FIG. 3). Such an action returns the alerting system to the initial monitoring state 405 and the process described above repeats. If the individual does not respond by pressing the push button of the communications equipment or otherwise activating a transmission within a second predetermined amount of time 420 (e.g. ~3 minutes), the alerting system 400 proceeds to a second alerting level 425 by sounding an audible alarm (e.g., a beeper that can be heard above ambient noise level of a busy room). The second predetermined amount of time 420 may be obtained and determined by the same or similar methods to those described above for the first predetermined amount of time 410 and is programmable to allow for user specification after installation. For example, the second predetermined amount of time 420 may be individually set from 1-90 minutes in 1 second increments or be disabled entirely. The second predetermined amount of time 420 may be the same as or different from the first predetermined amount of time 410.

The sounding of the audible alarm at the second alerting level 425 provides a second alert, aural in nature, to supplement or to replace the first visual alert. The audible alarm indicates to the individual working within the control tower that the alerting system 400 has detected a lack of transmission from the tower for longer than the first predetermined amount of time 410 and has not detected an adequate response to the first level of alert 415 within the second predetermined amount of time 420. The audible alarm is loud enough to be heard above average or nominal sounds or din of the room in which the audible alarm is to be heard. In some embodiments, the audible alarm may be loud enough to awaken an individual from a sleeping state. The audible alarm may be a simple beeping noise from a beeper, speaker or computer located in the control tower or may be a more piercing sound generated by a larger sound emitting device. The audible alarm may interface with the communications equipment (e.g., the communications equipment 310 of FIG. 3), such as through a headset or earpiece worn by the individual. In an alternative embodiment, the second alerting level 425 may include additional or alternative functionality aside from sounding of an audible alarm.

To reset the alerting system 400, similar to the above, the individual must press the push button or otherwise send an outgoing transmission via the communications equipment (e.g., the communications equipment 310 of FIG. 3). Such an action returns the alerting system to the initial monitoring state 405 and the entire process described above repeats. If the individual does not respond by pressing the push button of the communications equipment within a third predetermined amount of time 430 (e.g. ~3 minutes), the alerting system 400 proceeds to a third alerting level 435 by sounding a siren, sending an alert to command and control personnel of the controlling facility and/or alerting a Central Control Facility. The third predetermined amount of time 430 may be obtained and determined by the same or similar methods to those described above for the first predetermined amount of time 410 or the second predetermined amount of time 420 and is programmable to allow for user specification after installation. For example, the third predetermined amount of time 430 may be individually set from 1-90 minutes in 1 second increments or be disabled entirely. The third predetermined amount of time 430 may be the same as or different from either the first predetermined amount of time 410 or the second predetermined amount of time 420.

The sounding of the siren at the third alerting level 435 provides a third alert, aural in nature, to supplement or replace the first visual alert and the second audible alert. The siren indicates to the individual working within the control tower that the alerting system 400 has detected a lack of transmission from the tower for longer than the first predetermined amount of time 410 and has not detected an adequate response to either the first level of alert 415 within the second predetermined amount of time or the second level of alert 425 within the third predetermined amount of time. Similar to the audible alarm described above, the siren should be loud enough to awaken an individual from a sleeping state and may also notify other individuals in the vicinity of the control tower that there is a potential problem. The siren is a louder or more intense sound than the audible alarm of the second level of alert 425 in order to ensure that the individual in the control tower cannot sleep through the siren. The siren may be played through a separate piece of hardware (e.g., a loudspeaker) or the siren may be the same or a similar noise played through the same audible components previously discussed for the second alerting level 425, but at an increased volume level.

In addition to the aural siren, the third level of alert 435 may also send an alert to command and control personnel of a remote controlling facility or dispatch. Sending the alert may be performed simultaneously with the sounding of the siren or may be delayed by a fourth predetermined amount of time after the sounding of the siren. Sending the alert to the remote controlling facility or dispatch may be accomplished by a variety of methods, including placing a telephone call via an attached cell phone, cellular network or via hardware landlines (POTS) to a user-selectable telephone number and playing a user-defined voice message, sending a text message to a cellular device, sending a message to a pager device, illuminating a light at the headquarters of the controlling facility, sounding an alarm at the headquarters, sending a message via a communications system or computer network (e.g., the Internet) or any other means of notification to the command and control personnel of the controlling facility or dispatch that the control tower is not responding. If video or still cameras are positioned in the control tower, the cameras may be activated and the image sent to the headquarters. The third level of alert 435 may also be configured to send an alert to a Central Control Facility that monitors the responsiveness of various control towers or facilities utilizing the alerting system 400. The operation of the Central Control Facility may be as discussed in greater detail for FIG. 6 herein.

The third level of alert 435 may act as a final level of alert. To reset the alerting system 400, similar to the process described above, the individual must press the push button or otherwise send an outgoing transmission of the communications equipment (e.g., the communications equipment 310 of FIG. 3). Such an action returns the alerting system to the initial monitoring state 405 and the entire process described above repeats. If the individual does not respond by pressing the push button of the communications equipment, the alerting system 400 continues at the third stage of alert 435 until reset or the system is otherwise disabled or powered down. In an alternative embodiment, the third level of alert 435 may include additional or alternative functionality apart from sounding a siren or notifying one or more remote locations. An alternative embodiment may also use other means of resetting the alerting system 400 at any of the above described stages in addition to or in substitution of pressing the push button of the communications device.

Figure 5:
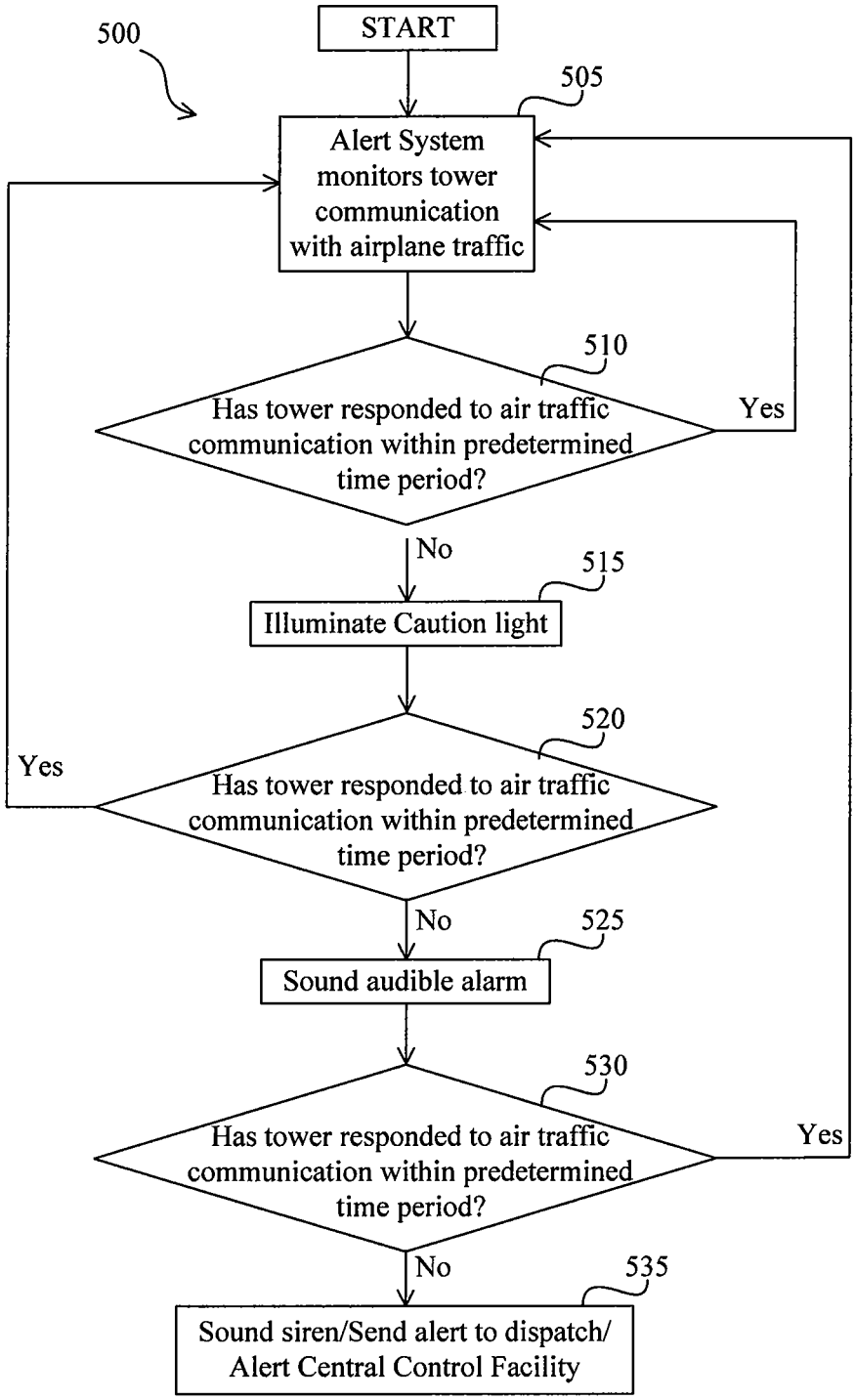
FIG. 5 is a flowchart of an air traffic controller alerting system according to an embodiment of the invention.

FIG. 5 shows a flowchart of the overall operation of an alternative air traffic controller alerting system 500. Certain aspects of the alerting system 500 may be the same or similar to alerting systems previously discussed. Similar to the alerting system 400 described above (see FIG. 4), upon initial boot-up of the system and during non-alerting operation, the alerting system 500 waits in a monitoring state 505. In the monitoring state 505, the alerting system 500 monitors a frequency or range of frequencies or channels of a receiver and/or transmitter used for communication between the control tower and airborne aircraft or other remote location. If an aircraft communicates with the control tower over a monitored frequency band or channel, the alerting system 500 detects the incoming communication via the monitored frequency band or channel. For example, the alerting system 500 may utilize radio frequency ("RF") signal fingerprinting wherein a unique radio transmitter identification is utilized for radio transmissions such that accurate monitoring, logging and/or statistics may be employed for alertness monitoring. If an individual working in the control tower does not respond to the incoming communication for a first predetermined amount of time 510 (e.g., 30 seconds), or if the incoming communication is repeated without a response, the alerting system proceeds to a first alerting level 515 by illuminating a caution or indicator light visible to the individual in the control tower.

The functionality of air traffic controller alerting system 500 contrasts from the air traffic controller alerting system 400 (see FIG. 4), for example, because the first predetermined amount of time 510 may be designed to be shorter in duration than the first predetermined amount of time 410 (see FIG. 4). While it may be expected that an individual working in the control tower will not need to transmit a communication as often (e.g., 20 minutes) as a general safety mechanism, particularly during red eye travel hours when there is not much traffic at an airport, the alerting system 500 operates by monitoring incoming aircraft communications that may require a response in a shorter timeframe to adequately protected public safety. Indeed, aircraft may seek authority to land or guidance from the control tower under much shorter time constraints (e.g., less than 1 minute).

The first predetermined amount of time 510 may be configured or stored in a way similar to the way time periods were programmed for the air traffic controller alerting system 400 (see above description for FIG. 4) and is programmable to allow for user specification after installation. Similar to the alerting system 400, the illumination of a caution light at a first alerting level 515 provides a first visual alert or indication to the individual working within the control tower that the alerting system 500 has detected a lack of transmission from the tower in response to an incoming communication. The caution light may be configured or positioned the same or similar to the caution light described above for the air traffic controller alerting system 400 (see above description for FIG. 4).

To reset the alerting system 500, the individual must respond to the aircraft communication via the usual communication channel or frequency. This response is detected by the alerting system 500 in the same or similar manner to the detection of the incoming aircraft communication. Other methods for response (e.g., pressing a transmit button or a reset button on a communications device) may be accepted to reset the alerting system 500. When the alerting system 500 detects such a response, the alerting system 500 resets to the initial monitoring state 505 and the process described above repeats. If the individual does not respond within a second predetermined amount of time 520 (e.g. ~30 seconds), the alerting system 500 proceeds to a second alerting level 525 by sounding an audible alarm. The second predetermined time 525 may be obtained and determined by the same or similar methods to those described above for the first predetermined amount of time 510 and is programmable to allow for user specification after installation. The second predetermined amount of time 520 may be the same as or different from the first predetermined amount of time 510.

The sounding of the audible alarm at the second alerting level 525 provides a second alert, audible in nature, to supplement or replace the first visual alert. The audible alarm indicates to the individual working within the control tower that the alerting system 500 has detected a lack of response from the control tower for longer than the first predetermined amount of time 510 and has not detected an adequate response to the first level of alert 515 within the second predetermined amount of time 520. The audible alarm may be the same or similar to the audible alarm described above for the air traffic controller alerting system 400 (see above description for FIG. 4).

To reset the alerting system 500, similar to the above, the individual must respond to the aircraft communication via the usual communication channel or frequency. Other methods for response (e.g., pressing a transmit button or a reset button on a communications device) may be accepted to reset the alerting system 500. Such an action returns the alerting system to the initial monitoring state 505 and the entire process described above repeats. If the individual does not respond to the aircraft communication within a third predetermined amount of time 530 (e.g. ~30 seconds), the alerting system 500 proceeds to a third alerting level 535 by sounding a siren, sending an alert to command and control personnel of the controlling facility and alerting a Central Control Facility. The third predetermined time 530 may be obtained and determined by the same or similar methods described above for the first predetermined amount of time 510 or the second predetermined amount of time 520 and is programmable to allow for user specification after installation.

The sounding of the siren at the third alerting level 535 provides a third alert, aural in nature, to supplement or replace the first visual alert and the second audible alert. The siren indicates to the individual working within the control tower that the alerting system 500 has detected a lack of response from the control tower to an aircraft communication for longer than the first predetermined amount of time 510 and has not detected an adequate response to either the first level of alert 515 or the second level of alert 525. The siren may be the same or similar to the siren described above for the air traffic controller alerting system 400 (see above description for FIG. 4).

In addition to the aural siren, the third level of alert 535 also sends an alert to command and control personnel of the controlling facility, which may be accomplished by the same or similar methods described above for the air traffic controller alerting system 400 (see above description for FIG. 4). The third level of alert 535 is also configured to send an alert to a Central Control Facility that monitors the responsiveness of various control towers or facilities utilizing the alerting system 500. Such remote notification to the dispatch or the Central Control Facility may occur simultaneously with the sounding of the siren of may occur after a fourth predetermined amount of time, also user-settable. The operation of the Central Control Facility may be as discussed in greater detail for FIG. 6 herein.

The third level of alert 535 may act as a final level of alert. To reset the alerting system 500, similar to the process described above, the individual must respond to the aircraft communication via the usual communication channel or frequency. Other methods for response (e.g., pressing a transmit button or a reset button on a communications device) may be accepted to reset the alerting system 500. Such an action returns the alerting system to the initial monitoring state 505 and the process described above repeats. If the individual does not appropriately respond, the alerting system 500 continues at the third stage of alert 535 until reset or the system is otherwise disabled or powered down.

In an alternative embodiment, the air traffic controller alerting system 500 may be combined with the air traffic controller alerting system 400 (see FIG. 4). Under such a system, both control tower transmissions in general via a communication device (for example, see discussion above for FIG. 3) and responsiveness to incoming communications is monitored. In such a system configuration, safety risks are further decreased by utilizing multiple inputs for the monitoring of control tower activity. In a further embodiment, additional inputs to an alerting system may be incorporated. Moreover, additional or substitutive alerts may be used for obtaining the attention of personnel in the tower (e.g., personal devices carried by personnel and not secured within the control tower that vibrate or emit sounds when activated).

Figure 6:
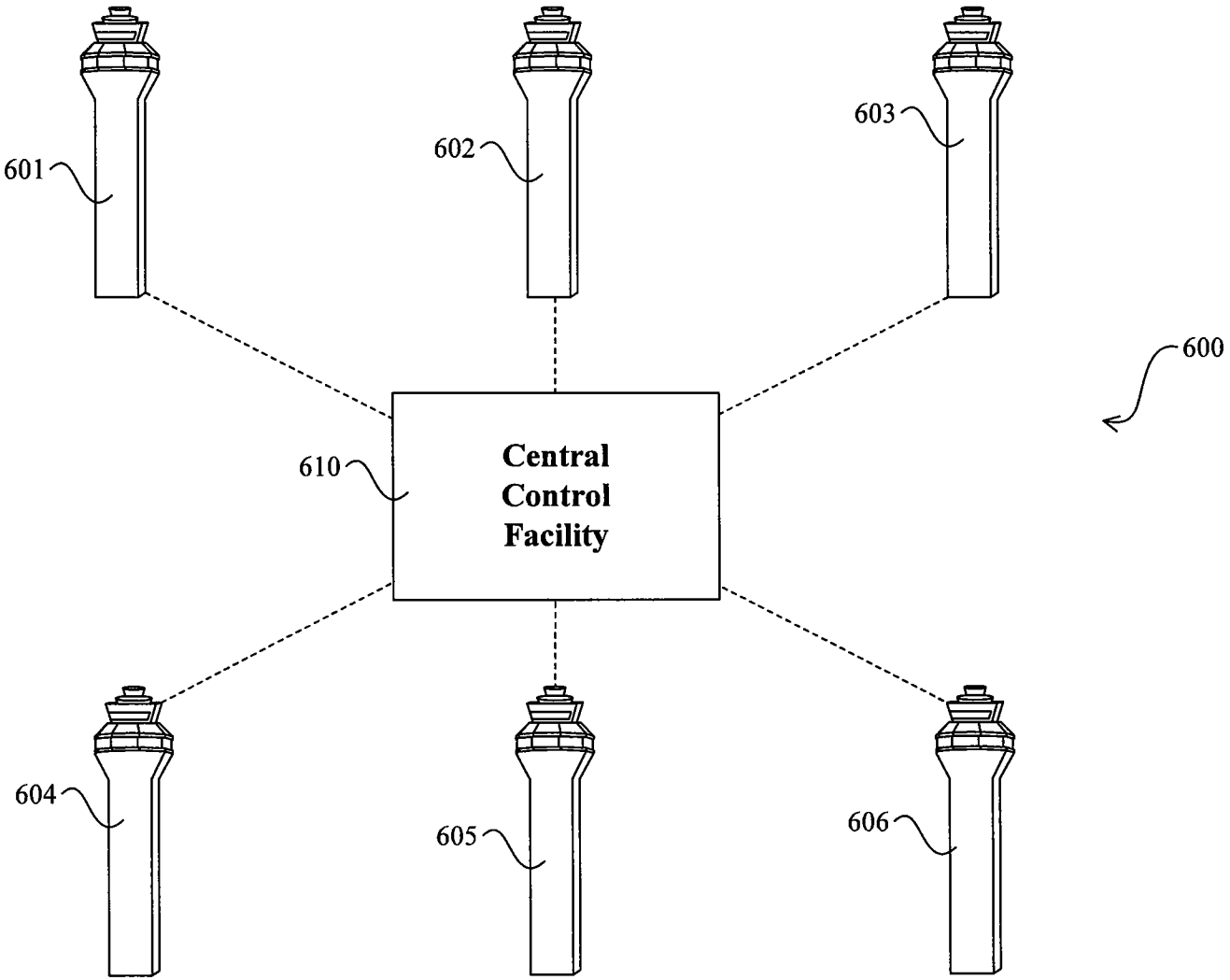
FIG. 6 is a view of multiple air traffic control facilities having air traffic controller alerting systems in communication with a central control facility according to an embodiment of the invention.

Referring next to FIG. 6, an air traffic controller alerting system 600 may utilize a Central Control Facility 610. For example, a plurality of control towers 601, 602, 603, 604, 605, 606 each interface with the Central Control Facility 610 when their respective alerting systems have reached the third stage of alert (see discussions above for FIG. 4 and FIG. 5). The control tower 601 notifies the Central Control Facility 610 via an indicator light, audible alarm, telephone or cell phone message or call, computer network message, or other communication or notification that the alerting system of the control tower 601 has reached the third or final stage of alert. Personnel at the Central Control Facility 610 can then begin procedures to make contact with the control tower 601 or other individuals associated with the control tower 601 to ensure that the control tower 601 is appropriately manned by a conscious individual. Similar operation occurs for each of the remaining control towers 602, 603, 604, 605, 606.

The Central Control Facility 610 functionality of the alerting system 600 may be subscription based wherein the owners of the control towers 601, 602, 603, 604, 605, 606 pay a monthly fee for the additional services of the Central Control Facility 610. Alternatively, the services of the Central Control Facility 610 may be paid for by a flat fee. The Central Control Facility 610 may be a mandatory feature of the alerting system 600 or may be an optional service such that the Central Control Facility 610 only interfaces with specific control towers that have paid for the service.

It shall be understood that the alerting system described by the embodiments above may be installed in any air traffic control facilities and is not limited to only control tower installation. In addition, it shall be understood that the alerting system is designed to appropriately monitor the equipment of such facilities. Different air traffic control facilities may utilize various communication systems or devices and those systems or devices are to be appropriately monitored by the alerting system despite any differences from the specific embodiments described above. An alternative embodiment of an alerting system may utilize alternative steps in addition to or in replacement of the steps specifically outlined in the flowcharts 400 or 500. An alternative embodiment may utilize greater or fewer process steps or with alternative ordering than as shown in the flowcharts 400 or 500.

Those of ordinary skill will appreciate that the various illustrative logical blocks, modules, and algorithm steps described in connection with the examples disclosed herein may be implemented as electronic hardware, computer software, or combinations of both. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosed apparatus and methods.

The logical steps for any energy diversion system for a braking system to devices utilizing such energy described in connection with the examples disclosed above may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an Application Specific Integrated Circuit (ASIC). The ASIC may reside in a wireless modem. In the alternative, the processor and the storage medium may reside as discrete components in the wireless modem.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. An air traffic control alerting system comprising:

a communication device for communicating with a remote location, the communication device having a transmit state and a receive state;

a controller configured to monitor the communication device for determining if the communication device is in the transmit state or the receive state;

a visual indicator coupled with the controller and configured to be activated by the controller if the communication device does not change from the receive state to the transmit state after a first predetermined amount of time;

an audible indicator coupled with the controller and configured to be activated by the controller at a first volume if the communication device does not change from the receive state to the transmit state after a second predetermined amount of time after the activation of the visual indicator; and a notification configured to be sent by the controller to a remote device if the communication device does not change from the receive state to the transmit state after a third predetermined amount of time after the activation of the audible indicator at the first volume.

2. The air traffic control alerting system of claim 1 wherein the communication device includes a button for changing the communication device from the receive state to the transmit state when the button is pressed.

3. The air traffic control alerting system of claim 2 wherein the visual indicator is a light within visual proximity of the communication device.

4. The air traffic control alerting system of claim 2 wherein the audible indicator is a beeper.

5. The air traffic control alerting system of claim 4 wherein the beeper is configured to be activated by the controller at a second volume louder than the first volume if the communication device does not change from the receive state to the transmit state after the third predetermined amount of time after the activation of the beeper at the first volume.

6. The air traffic control alerting system of claim 4 further comprising a loudspeaker configured to produce a siren at a second volume louder than the first volume if the communication device does not change from the receive state to the transmit state after the third predetermined amount of time after the activation of the beeper at the first volume.

7. The air traffic control alerting system of claim 1 wherein the visual indicator is configured to be activated by the controller after the first predetermined amount of time elapses from receipt of an incoming communication by the communication device without an outgoing communication transmitted by the communication device.

8. The air traffic control alerting system of claim 1 wherein the visual indicator is configured to be activated by the controller after the first predetermined amount of time elapses from receipt of a plurality of incoming communications having a same radio frequency fingerprint by the communication device without an outgoing communication transmitted by the communication device.

9. The air traffic control alerting system of claim 1 wherein the first predetermined amount of time, the second predetermined amount of time or the third predetermined amount of time are configured to be user-programmable.

10. An air traffic control alerting system for use in an air traffic control facility, the alerting system comprising:

a receiver for receiving, over at least one frequency, an incoming communication at the air traffic control facility from a location remote from the air traffic control facility;

a transmitter for transmitting, over the at least one frequency, an outgoing communication from the air traffic control facility to the location remote from the air traffic control facility;

a controller configured to monitor the at least one frequency for the incoming communication by the receiver and the outgoing communication by the transmitter;

a light connected with the controller and configured to be activated by the controller after a first predetermined amount of time elapses from receipt of the incoming communication by the receiver if there is no outgoing communication transmitted by the transmitter;

a speaker connected with the controller and configured to be activated by the controller after a second predetermined amount of time elapses from the activation of the light if there is no outgoing communication transmitted by the transmitter; and a memory connected with the controller and configured to store a telephone number and a message, the message transmitted according to the telephone number after a third predetermined amount of time elapses from activation of the speaker if there is no outgoing communication transmitted by the transmitter.

11. The air traffic control alerting system of claim 10 wherein the message is a predefined textual message or a digitized voice message.

12. The air traffic control alerting system of claim 10 wherein the light is configured to be activated by the controller if a plurality of incoming communications having the same radio frequency fingerprint are received by the receiver and there is no outgoing communication transmitted by the transmitter.

13. The air traffic control alerting system of claim 10 further comprising a web server connected with the controller, the web server configured to receive the incoming communication and the outgoing communication for streaming of the incoming communication and the outgoing communication over the Internet.

14. The air traffic control alerting system of claim 10 wherein the controller is configured to be remotely accessible via the Internet for setting the first predetermined amount of time, the second predetermined amount of time, the telephone number or the message.

15. A method of reducing inattentiveness during air traffic control communication over at least one frequency between a control tower and an aircraft, the method comprising:

monitoring the at least one frequency for an incoming communication from the aircraft or an outgoing communication from the control tower;

activating a visual indicator after a first predetermined amount of time if no outgoing communication from the control tower has occurred;

activating an audible indicator at a first volume after a second predetermined amount of time after the activation of the visual indicator if no outgoing communication from the control tower has occurred;

activating the audible indicator at a second volume louder than the first volume after a third predetermined amount of time after the activation of the audible indicator at the first volume if no outgoing communication from the control tower has occurred; and sending a pre-recorded message via a network to a remote location after a fourth predetermined amount of time after the activation of the audible indicator at the second volume if no outgoing communication from the control tower has occurred.

16. The method of claim 15 wherein the step of sending the pre-recorded message via the network to a remote location includes using the controller to dial a predetermined telephone number using a POTS landline.

17. The method of claim 15 wherein the step of sending the pre-recorded message via the network to a remote location includes using the controller to dial a predetermined telephone number using a cellular network.

18. The method of claim 15 wherein the step of sending the pre-recorded message via the network to a remote location includes using the controller to connect to a predetermined network address using the Internet.

19. The method of claim 15 further comprising the step of sending the incoming communication and the outgoing communication to a webserver accessible via the Internet for real-time streaming.

20. The method of claim 15 further comprising the step of activating the visual indicator when a predetermined number of incoming communications from the aircraft are received without an outgoing communication from the control tower.

* * * * *